US008655248B2

(12) United States Patent
Nakao et al.

(10) Patent No.: US 8,655,248 B2
(45) Date of Patent: Feb. 18, 2014

(54) FIXING DEVICE, IMAGE FORMING APPARATUS, AND ENDLESS FIXING BELT

(75) Inventors: Masayoshi Nakao, Kanagawa (JP); Hideaki Ohhara, Kanagawa (JP); Motofumi Baba, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 329 days.

(21) Appl. No.: 13/238,874

(22) Filed: Sep. 21, 2011

(65) Prior Publication Data

US 2012/0251205 A1 Oct. 4, 2012

(30) Foreign Application Priority Data

Mar. 28, 2011 (JP) ..... 2011-070399

(51) Int. Cl.
*G03G 15/20* (2006.01)

(52) U.S. Cl.
USPC ..... 399/329; 399/333

(58) Field of Classification Search
USPC ..... 399/328, 329, 330, 333
See application file for complete search history.

(56) References Cited

U.S. PATENT DOCUMENTS

| | | | | |
|---|---|---|---|---|
| 7,433,642 | B2 * | 10/2008 | Higashi et al. | 399/333 |
| 7,593,681 | B2 * | 9/2009 | Tamemasa et al. | 399/333 |
| 7,668,496 | B2 * | 2/2010 | Tamemasa et al. | 399/329 |
| 7,835,679 | B2 | 11/2010 | Baba et al. | |

FOREIGN PATENT DOCUMENTS

| | | |
|---|---|---|
| JP | B2-4019853 | 12/2007 |

* cited by examiner

*Primary Examiner* — Sandra Brase
(74) *Attorney, Agent, or Firm* — Oliff PLC

(57) ABSTRACT

A fixing device includes a magnetic-field-producing member producing an alternating-current magnetic field, a fixing belt that is heated by electromagnetic induction caused by the alternating-current magnetic field and fixes toner on a recording material, and a pressure applying member pressed against the fixing belt and forming a press-fixing part therebetween through which the recording material having an unfixed image is transported. The fixing belt includes a metal body that is a stack of at least three layers including a base layer and a protective layer both made of metal, and a conductive layer provided between the base layer and the protective layer and to be heated by electromagnetic induction. In a section of the fixing belt taken in a thickness direction, the metal body has its neutral axis on a side of the protective layer with respect to a thickness center line thereof and in the protective layer.

20 Claims, 8 Drawing Sheets

FIG. 9

| No. | LAYERS OF METAL BODY (PROTECTIVE LAYER, CONDUCTIVE HEATING LAYER, BASE LAYER) | TOTAL THICKNESS (μm) | PROTECTIVE LAYER (μm) | CONDUCTIVE HEATING LAYER (μm) | BASE LAYER (μm) | DISTANCE FROM INTERFACE BETWEEN PROTECTIVE LAYER AND CONDUCTIVE HEATING LAYER TO NEUTRAL AXIS (μm) | DISTANCE FROM SURFACE OF PROTECTIVE LAYER TO NEUTRAL AXIS (μm) | TENSILE STRAIN | DURABILITY |
|---|---|---|---|---|---|---|---|---|---|
| A1 | SUS, Cu, SUS | 55 | 27.5 | 8 | 19.5 | 0.2 | 27.3 | 0.219 | GOOD |
| A2 | SUS, Cu, SUS | 55 | 27.5 | 11 | 16.5 | 0.39 | 27.11 | 0.218 | GOOD |
| A3 | SUS, Cu, Al | 55 | 23.5 | 8 | 23.5 | 1.93 | 21.57 | 0.197 | GOOD |
| A4 | SUS, Cu, Al | 55 | 22 | 11 | 22 | 0.33 | 21.67 | 0.198 | GOOD |
| A5 | SUS, Cu, Al | 55 | 25 | 11 | 19 | 3 | 22 | 0.201 | GOOD |
| A6 | SUS, Cu, Fe–Ni | 55 | 28 | 8 | 19 | 2.87 | 25.13 | 0.230 | GOOD |
| B1 | SUS, Cu, SUS | 55 | 30 | 11 | 14 | 2.3 | 27.7 | 0.222 | NO GOOD |
| C1 | SUS, Cu, Fe–Ni | 55 | 23.5 | 8 | 23.5 | −1.6 | 25.1 | 0.229 | OK |
| C2 | SUS, Cu, Fe–Ni | 55 | 22 | 11 | 22 | −3.1 | 25.1 | 0.229 | OK |
| D1 | SUS, Cu, SUS | 55 | 22 | 11 | 22 | −5.5 | 27.5 | 0.221 | NO GOOD |
| D2 | SUS, Cu, SUS | 55 | 23.5 | 8 | 23.5 | −4 | 27.5 | 0.221 | NO GOOD |
| D3 | SUS, Cu, SUS | 55 | 19.5 | 8 | 27.5 | −8.2 | 27.7 | 0.222 | NO GOOD |
| D4 | SUS, Cu, SUS | 55 | 22 | 11 | 22 | −5.5 | 27.5 | 0.221 | NO GOOD |
| D5 | Al, Cu, SUS | 55 | 23.5 | 8 | 23.5 | −9.5 | 33 | 0.301 | NO GOOD |
| D6 | Fe–Ni, Cu, SUS | 55 | 23.5 | 8 | 23.5 | −6.35 | 29.85 | 0.273 | NO GOOD |

FIXING DEVICE, IMAGE FORMING APPARATUS, AND ENDLESS FIXING BELT

CROSS-REFERENCE TO RELATED APPLICATIONS

This application is based on and claims priority under 35 USC 119 from Japanese Patent Application No. 2011-070399 filed Mar. 28, 2011.

BACKGROUND (i) Technical Field

The present invention relates to a fixing device, an image forming apparatus, and an endless fixing belt.

(ii) Related Art

An electrophotographic image forming apparatus such as a copier or a printer forms an electrostatic latent image on a photoconductor having, for example, a drum-like shape by uniformly charging the photoconductor and exposing the charged photoconductor to light controlled on the basis of image information. The electrostatic latent image is developed with toner into a visible image (toner image). The toner image is transferred to a recording material. The transferred toner image is fixed by a fixing device. Thus, an image is formed. Some known fixing devices employ a technique of electromagnetic induction heating.

SUMMARY

According to an aspect of the invention, there is provided a fixing device including a magnetic-field-producing member that produces an alternating-current magnetic field, a fixing belt that is heated by electromagnetic induction caused by the alternating-current magnetic field and fixes toner on a recording material, and a pressure applying member that is pressed against an outer peripheral surface of the fixing belt and forms a press-fixing part therebetween through which the recording material having an unfixed image is transported. The fixing belt includes a metal body in which at least three layers are stacked. The at least three layers include a base layer made of metal, a protective layer made of metal, and a conductive layer provided between the base layer and the protective layer and to be heated by electromagnetic induction. In a section of the fixing belt taken in a thickness direction, a neutral axis of the metal body resides on a side of the protective layer with respect to a thickness center line of the metal body and in the protective layer.

BRIEF DESCRIPTION OF THE DRAWINGS

An exemplary embodiment of the present invention will be described in detail based on the following figures, wherein:

FIG. 9 summarizes conditions and results of tests for individual examples and comparative examples.

DETAILED DESCRIPTION

An exemplary embodiment of the present invention will now be described in detail with reference to the accompanying drawings.

Image Forming Apparatus

Figure 1:
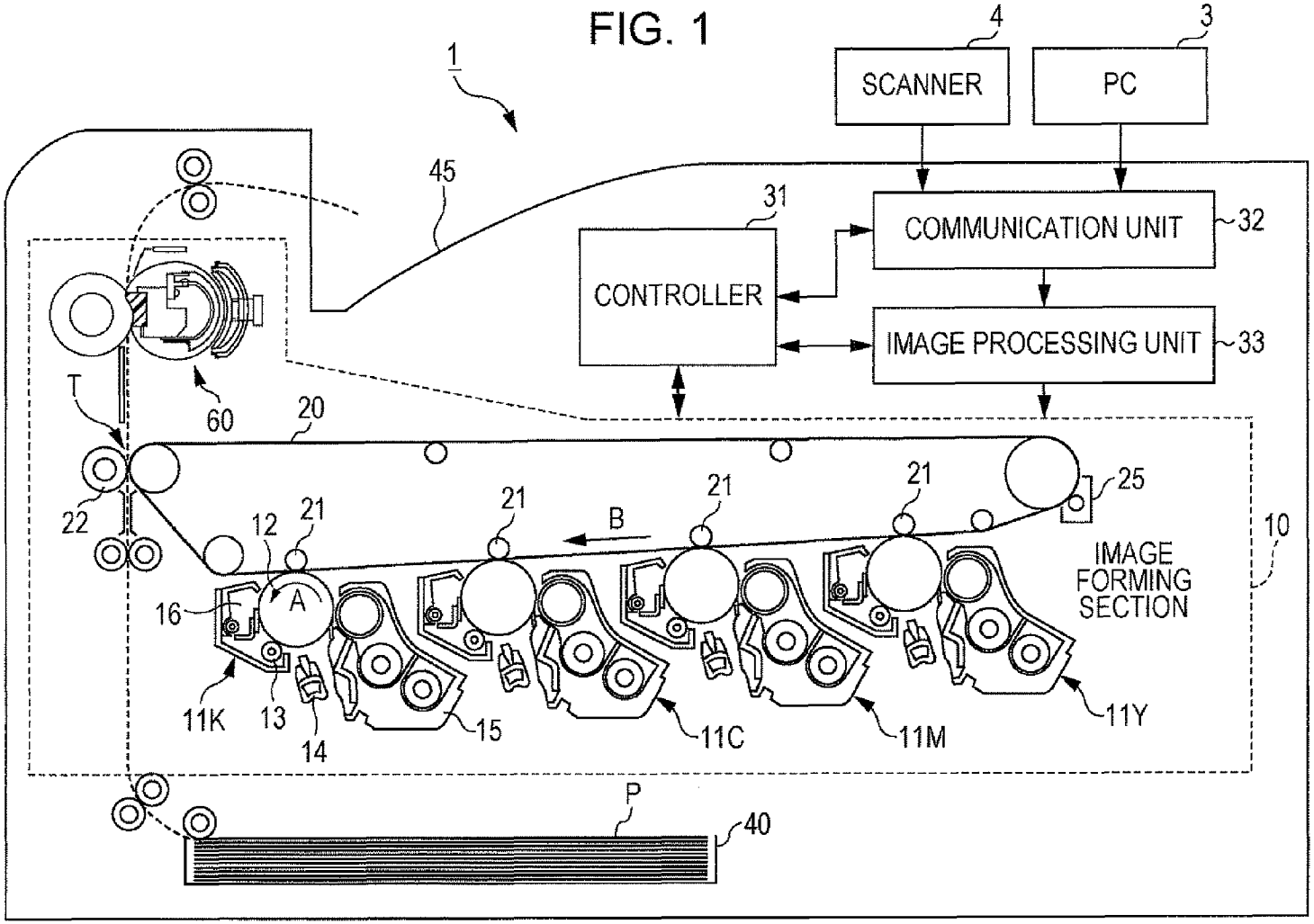
FIG. 1 illustrates an exemplary image forming apparatus to which a fixing device according to the exemplary embodiment is applied.

FIG. 1 illustrates an exemplary image forming apparatus 1 to which a fixing device according to the exemplary embodiment is applied. The image forming apparatus 1 illustrated in FIG. 1 is a tandem color printer and includes an image forming section 10 that forms an image on the basis of image data, a controller 31 that controls the overall operation of the image forming apparatus 1, a communication unit 32 that communicates with, for example, a personal computer (PC) 3 or an image reading device (scanner) 4 and receives the image data, and an image processing unit 33 that performs a predetermined image processing operation on the image data received by the communication unit 32.

The image forming section 10 is an exemplary toner-image-forming section that forms a toner image. The image forming section 10 includes four image forming units 11Y, 11M, 11C, and 11K (also generally referred to as "image forming units 11") that are provided side by side at predetermined intervals. The image forming units 11 each include a photoconductor drum 12 as an exemplary image carrier on which an electrostatic latent image is formed and that carries a toner image, a charging device 13 that uniformly charges the surface of the photoconductor drum 12 with a predetermined potential, a light-emitting-diode (LED) printhead 14 that performs, on the basis of image data for a corresponding one of different colors, exposure on the photoconductor drum 12 charged by the charging device 13, a developing device 15 that develops the electrostatic latent image formed on the photoconductor drum 12, and a drum cleaner 16 that cleans the surface of the photoconductor drum 12 after transfer.

The image forming units 11 all have substantially the same configuration except the colors of toners contained in the developing devices 15. The image forming units 11 form toner images in different colors of yellow (Y), magenta (M), cyan (C), and black (K), respectively.

The image forming section 10 also includes an intermediate transfer belt 20 to which the toner images in different colors formed on the photoconductor drums 12 of the respective image forming units 11 are multiply transferred, first transfer rollers 21 with which the toner images in different colors formed by the respective image forming units 11 are sequentially transferred (first-transferred) to the intermediate transfer belt 20 in such a manner as to be superposed one on top of another, a second transfer roller 22 with which the toner images in different colors superposed on the intermediate transfer belt 20 are transferred at a time (second-transferred) to paper 2, i.e., a recording material (recording paper), and a fixing unit 60 as an exemplary fixing section (fixing device) that fixes the second-transferred toner images in different colors on the paper P. In the image forming apparatus 1 according to the exemplary embodiment, the intermediate transfer belt 20, the first transfer rollers 21, and the second transfer roller 22 in combination form a transfer section that transfers the toner images to the paper P.

The image forming apparatus 1 according to the exemplary embodiment performs an image forming operation in the following process under the control of the controller 31. Specifically, image data from the PC 3 or the scanner 4 is received by the communication unit 32 and is subjected to the predetermined image processing operation performed by the image processing unit 33, thereby being converted into pieces of image data for the different colors. The pieces of image data are transmitted to the respective image forming units 11. For example, in the image forming unit 11K that forms a black (K)-colored toner image, the photoconductor drum 12 rotating in the direction of arrow A is uniformly charged with the predetermined potential by the charging device 13, and the LED printhead 14 performs scan exposure on the photoconductor drum 12 on the basis of the piece of image data for the K color transmitted from the image processing unit 33. Thus, an electrostatic latent image for the K color is formed on the photoconductor drum 12. The electrostatic latent image for the K color on the photoconductor drum 12 is developed by the developing device 15, whereby a K-colored toner image is formed on the photoconductor drum 12. Likewise, yellow (Y)-colored, magenta (M)-colored, and cyan (C)-colored toner images are formed by the other image forming units 11Y, 11M, and 11C, respectively.

The different-colored toner images thus formed on the photoconductor drums 12 of the respective image forming units 11 are sequentially electrostatically transferred (first-transferred) to the intermediate transfer belt 20 rotating in the direction of arrow B by the respective first transfer rollers 21, whereby superposed toner images in which the different-colored toners are superposed are formed. The superposed toner images on the intermediate transfer belt 20 are transported, with the rotation of the intermediate transfer belt 20, to an area (second transfer part T) where the second transfer roller 22 is provided. When the superposed toner images reach the second transfer part T, paper P fed from a paper holder 40 is transported to the second transfer part T. Subsequently, at the second transfer part T, the superposed toner images are electrostatically transferred at a time (second-transferred) to the thus transported paper P by an effect of a transfer electric field produced by the second transfer roller 22.

Subsequently, the paper P having the superposed toner images electrostatically transferred thereto is transported to the fixing unit 60. The superposed toner images on the paper P transported to the fixing unit 60 are subjected to heat and pressure applied by the fixing unit 60 and are thus fixed on the paper P. The paper P having the thus fixed image is transported to a paper stacking part 45 in a paper output portion of the image forming apparatus 1.

Meanwhile, toners adhering to the photoconductor drums 12 after the first transfer (first-transfer residual toner) and toners adhering to the intermediate transfer belt 20 after the second transfer (second-transfer residual toner) are removed by the drum cleaners 16 and a belt cleaner 25, respectively.

The image forming apparatus 1 repeats the above image forming process for the number of pages to be printed.

Fixing Unit

The fixing unit 60 according to the exemplary embodiment will now be described.

Figure 2:
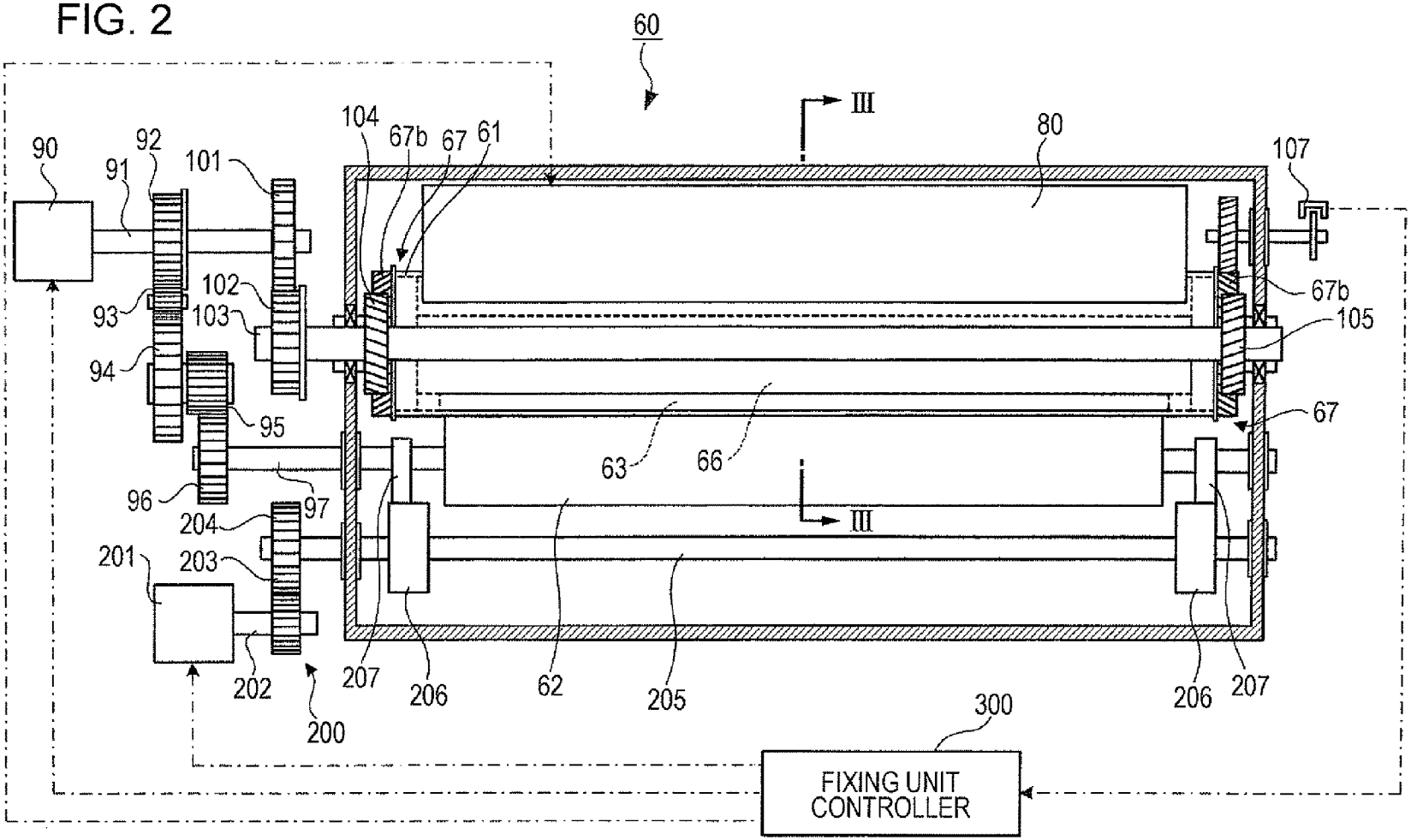
FIG. 2 is a front view of the fixing device according to the exemplary embodiment.
Figure 3:
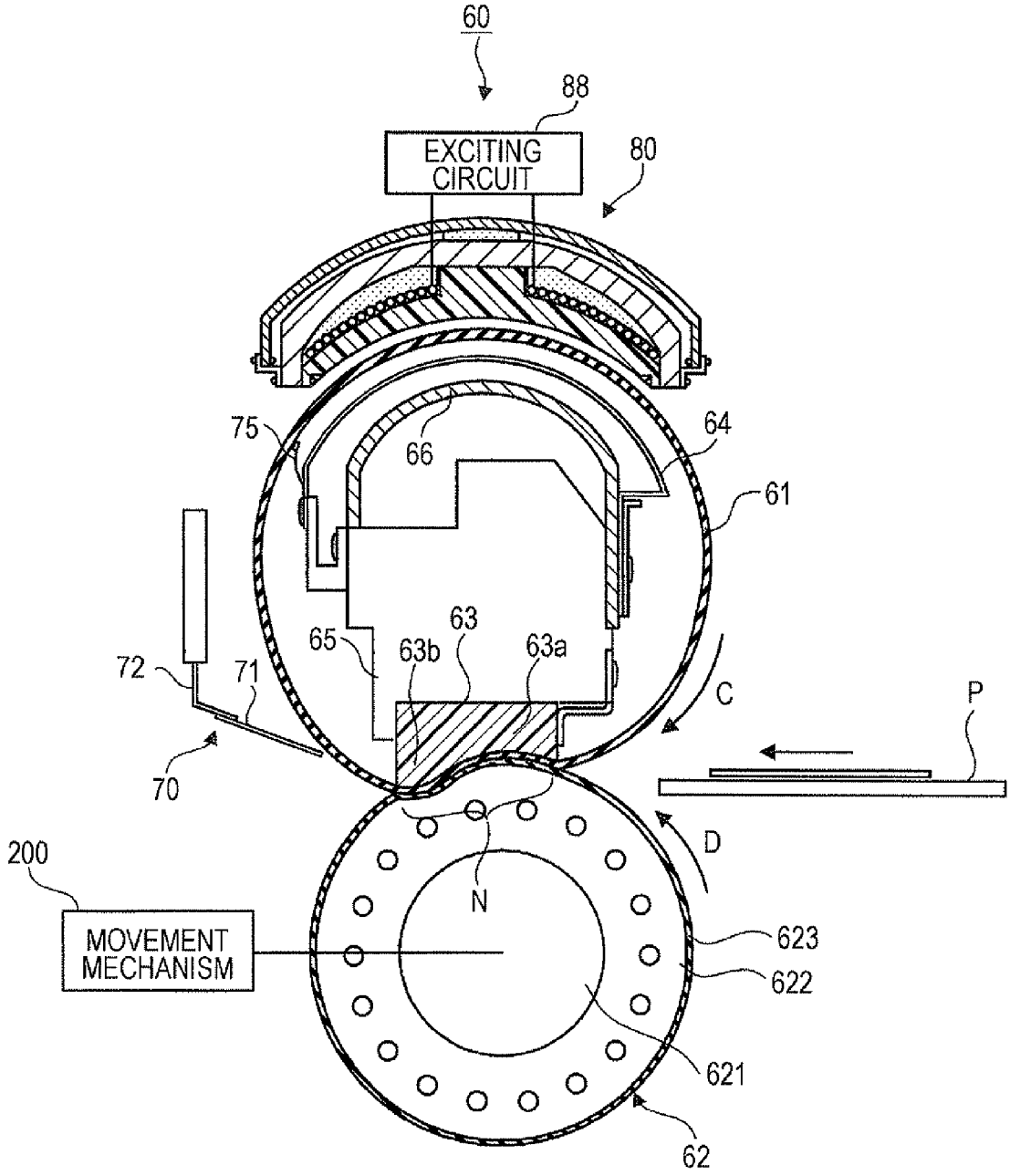
FIG. 3 is a sectional view of the fixing device taken along line III-III illustrated in FIG. 2.

FIGS. 2 and 3 illustrate the fixing unit 60 according to the exemplary embodiment. FIG. 2 is a front view. FIG. 3 is a sectional view taken along line III-III illustrated in FIG. 2.

Referring to the sectional view of FIG. 3, the fixing unit 60 includes an induction-heating (IH) heater 80 that produces an alternating-current magnetic field, a fixing belt 61 as an exemplary fixing member that is heated by electromagnetic induction caused by the IH heater 80 and thus fixes toner images on paper P, a pressure applying roller 62 as an exemplary pressure applying member that faces the fixing belt 61, and a pressure receiving pad 63 against which the pressure applying roller 62 is pressed with the fixing belt 61 interposed therebetween.

Furthermore, the fixing unit 60 includes a holder 65 that supports the pressure receiving pad 63 and other elements, a temperature-sensitive magnetic member 64 that produces a magnetic circuit by inducing thereinto the alternating-current magnetic field produced by the IH heater 80, an induction member 66 that induces thereinto lines of magnetic force that have passed through the temperature-sensitive magnetic member 64, a release assisting member 70 that assists releasing of the paper P from the fixing belt 61, and a temperature sensor 75 that is in contact with the surface of the fixing belt 61 and detects the temperature of the fixing belt 61. The pressure applying roller 62 is moved by a movement mechanism 200 in the following manner. When a fixing operation is performed, the pressure applying roller 62 is pressed against the outer peripheral surface of the fixing belt 61, whereby a nip part N (press-fixing part) through which the paper P having unfixed toner images is transported is formed between the pressure applying roller 62 and the fixing belt 61. In contrast, when the fixing operation is not performed, the pressure applying roller 62 is spaced apart from the fixing belt 61. Details of the movement mechanism 200 will be described separately below.

Fixing Belt

Figure 4:
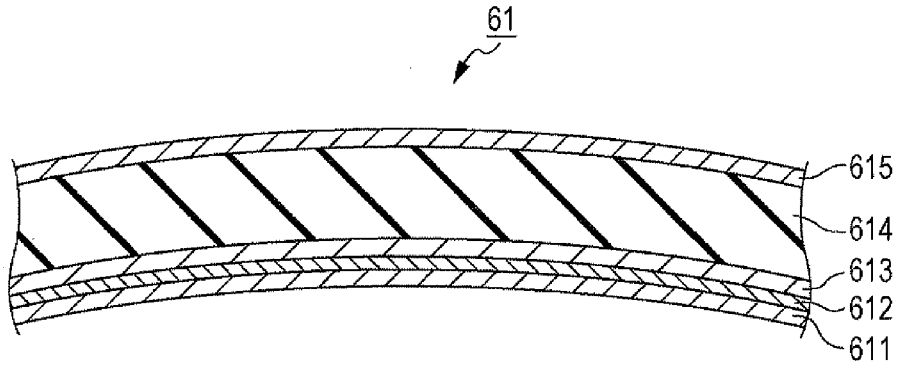
FIG. 4 is a sectional view illustrating layers included in a fixing belt according to the exemplary embodiment.

The fixing belt 61 is an endless belt member that originally has a round cylindrical shape with, for example, a diameter of 30 mm in its original shape (round cylindrical shape) and a length of 370 mm. Referring to FIG. 4 (a sectional view illustrating layers included in the fixing belt 61), the fixing belt 61 is a multilayer belt member including a base layer 611, a conductive heating layer 612 overlying the base layer 611, a protective layer 613 protecting the conductive heating layer 612, an elastic layer 614 improving the capability of fixing toner images, and a release layer 615 provided as the outermost layer. The base layer 611, the conductive heating layer 612, and the protective layer 613 in combination form a clad-steel metal body produced by being bonded to one another.

The base layer 611 forms the inner peripheral surface of the fixing belt 61. The base layer 611 supports the conductive heating layer 612, which has a small thickness, and is required to provide good mechanical strength to the fixing belt 61 as a whole. The base layer 611 is made of a material having a thickness and physical properties (relative permeability and resistivity) that allow the alternating-current magnetic field produced by the IH heater 80 to pass therethrough and to act on the temperature-sensitive magnetic member 64. The base layer 611 itself, however, does not generate heat or hardly generates heat with the effect of the magnetic field.

Specifically, for example, the base layer 611 has a thickness of 30 μm to 200 μm (preferably, 50 μm to 150 μm) and is made of non-magnetic metal or the like such as non-magnetic stainless steel.

The conductive heating layer 612 is an exemplary conductive layer and is an electromagnetic-induction heating layer that is heated by electromagnetic induction caused by the alternating-current magnetic field produced by the IH heater 80. That is, an eddy current occurs in the conductive heating layer 612 when the alternating-current magnetic field produced by the IH heater 80 passes through the conductive heating layer 612 in the thickness direction.

Usually, a general-purpose power supply manufacturable at a low cost is used as the power source for an exciting circuit 88 (see FIG. 6) that supplies an alternating current to the IH heater 80. Therefore, the frequency of the alternating-current magnetic field produced by the IH heater 80 usually ranges from 20 kHz to 100 kHz, corresponding to the frequency of the general-purpose power supply. Hence, the conductive heating layer 612 is configured to allow an alternating-current magnetic field at a frequency of 20 kHz to 100 kHz to enter and pass therethrough.

The alternating-current magnetic field is allowed to enter a region of the conductive heating layer 612 where the alternating-current magnetic field is attenuated to 1/e. The region is defined by "skin depth (δ)", which is obtained from Expression (1) below.

$$\delta = 503\sqrt{\frac{\rho}{f \cdot \mu_r}} \quad (1)$$

where f denotes the frequency of the alternating-current magnetic field (20 kHz, for example), ρ denotes the resistivity (Ω·m), and μ denotes the relative permeability.

Hence, the conductive heating layer 612 is thinner than the skin depth (δ) of the conductive heating layer 612 defined by Expression (1) so that an alternating-current magnetic field at a frequency of 20 kHz to 100 kHz is allowed to enter and pass through the conductive heating layer 612. Exemplary materials for the conductive heating layer 612 include metals such as Au, Ag, Al, Cu, Zn, Sn, Pb, Bi, Be, and Sb, and alloys of any of the foregoing metals.

Specifically, for example, the conductive heating layer 612 has a thickness of 2 μm to 20 μm and a resistivity of $2.7\times10^{-8}$ Ω·m or smaller and is made of non-magnetic metal such as Cu (non-magnetic material having a relative permeability of about 1).

The conductive heating layer 612 may have such a small thickness in terms of reducing the time required for heating the fixing belt 61 to a preset fixing temperature (hereinafter referred to as "warm-up time").

The protective layer 613 is provided so as to protect the conductive heating layer 612 and is therefore required to have a predetermined mechanical strength and to hardly prevent the electromagnetic induction into the conductive heating layer 612. Hence, the protective layer 613 does not generate heat or hardly generates heat with the effect of the magnetic field, as in the case of the base layer 611.

Specifically, the protective layer 613 is made of non-magnetic metal or the like such as non-magnetic stainless steel.

The elastic layer 614 is made of a heat-resistive elastic material such as silicone rubber. Toner images on the paper P, i.e., the object of fixing, are layers of powder toners having different colors. Therefore, to heat the entirety of the toner images very uniformly at the nip part N, the surface of the fixing belt 61 may be deformable along a rugged surface formed by the toner images on the paper P. In such a case, silicone rubber having, for example, a thickness of 100 μm to 600 μm and a hardness of 10° to 30° (JIS-A) is suitable for the elastic layer 614.

The release layer 615 forms the outer peripheral surface of the fixing belt 61. The release layer 615 directly comes into contact with unfixed toner images on the paper P and is therefore made of a material having a high releasability. Examples of such a material include a tetrafluoroethylene-perfluoroalkyl vinyl ether copolymer (PFA), polytetrafluoroethylene (PTFE), a silicone copolymer, and a composite of the foregoing materials. If the release layer 615 is too thin, abrasion resistance is insufficient and the life of the fixing belt 61 is shortened. In contrast, if the release layer 615 is too thick, the heat capacity of the fixing belt 61 is too large and the warm-up time is increased. Considering the balance between abrasion resistance and heat capacity, the thickness of the release layer 615 may be 1 μm to 50 μm.

The fixing belt 61 configured as above is produced in the following manner, for example.

(i) A material for the base layer 611 such as a stainless steel plate, a material for the conductive heating layer 612 such as a copper plate, and a material for the protective layer 613 such as a stainless steel plate are stacked one on top of another, and rolling or the like is performed on the stack, whereby a ply metal plate is produced.

(ii) The ply metal plate is punched into a circular shape with a punch press and is then drawn into a shallow cup shape.

(iii) The shallow-cup-shaped body is further drawn such that the sidewall thereof is lengthened and becomes thinner.

(iv) The resulting body is cut at two ends thereof in such a manner as to have a predetermined width, whereby a round-cylindrical metal body in the form of an endless belt in which the base layer 611, the conductive heating layer 612, and the protective layer 613 are stacked is produced.

(v) An elastic layer 614 and a release layer 615 are sequentially provided over the metal body, whereby the fixing belt 61 is produced.

The fixing belt 61 fixes toner while being bent at the nip part N. When the fixing belt 61 is bent, an internal stress occurs in the fixing belt 61. Since the fixing belt 61 according to the exemplary embodiment has a complex layered structure, fatigue due to the internal stress tends to be accumulated thereinside. Consequently, the fixing belt 61 may have local fractures leading to failure. Such fractures tend to occur at surfaces of the metal body including the base layer 611, the conductive heating layer 612, and the protective layer 613. In particular, the protective layer 613 tends to receive a relatively large tensile stress. Therefore, a surface of the protective layer 613 that is in contact with the elastic layer 614 tends to have cracks. Such cracks may grow into local fractures of the fixing belt 61.

To suppress the occurrence of such fractures, the fixing belt 61 according to the exemplary embodiment is configured such that, in a section of the fixing belt 61 taken in the thickness direction, the neutral axis of the metal body resides on the side of the protective layer 613 with respect to the thickness center line of the metal body and in the protective layer 613.

In the exemplary embodiment, the neutral axis refers to the position where no internal stress occurs in the fixing belt 61 when, for example, a bending force is applied to the fixing belt 61 from the inner peripheral side. With respect to the neutral axis, a compressive stress occurs on the inner peripheral side of the fixing belt 61, whereas a tensile stress occurs on the outer peripheral side of the fixing belt 61. When a bending force is applied to the fixing belt 61 from the outer peripheral side, the position of the neutral axis does not change but the sides of the compressive stress and the tensile stress are reversed with respect to the neutral axis. That is, a tensile stress occurs on the inner peripheral side of the fixing belt 61, whereas a compressive stress occurs on the outer peripheral side of the fixing belt 61.

Expression (2) below is a general expression for calculating the position of the neutral axis in the exemplary embodiment.

$$y_0=\Sigma(E_i\int_{A_i}ydA_i)/\Sigma E_iA_i \quad (2)$$

Expression (2) will now be described with reference to FIG. 5.

Figure 5:
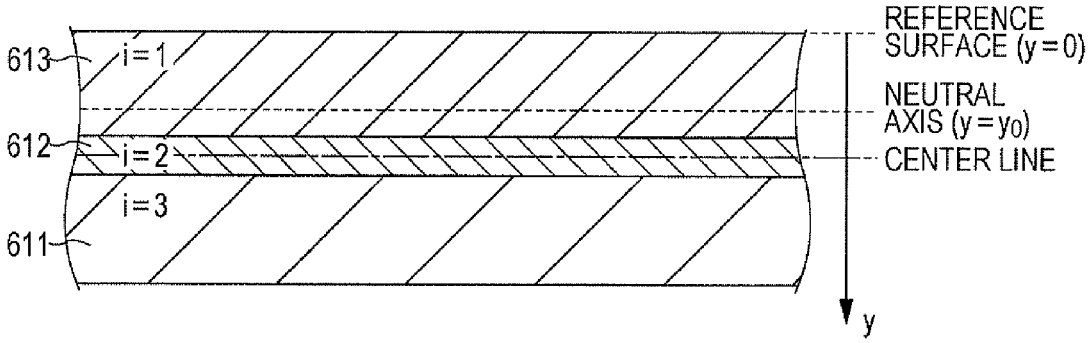
FIG. 5 is a schematic sectional view of a metal body including a base layer, a conductive heating layer, and a protective layer.

FIG. 5 is a schematic sectional view of the metal body including the base layer 611, the conductive heating layer 612, and the protective layer 613. As illustrated in FIG. 5, a surface of the protective layer 613 on the outer peripheral side is taken as the reference surface, and the distance from the reference surface in the thickness direction of the metal body is denoted by y. Here, supposing that the metal body includes n layers and letting the Young's modulus and sectional area of the i-th layer counted from the reference surface be $E_i$ and $A_i$, respectively, the position of the neutral axis is expressed as the distance in the thickness direction of the metal body, the distance being denoted by $y_0$. The distance $y_0$ is calculated from Expression (2). The fact that the neutral axis of the metal body resides in the protective layer 613 means that the neutral axis of the metal body resides in the section of the protective layer 613 illustrated in FIG. 5.

To calculate the position of the neutral axis on the basis of the unit width of each of the layers, $dA_i$ is replaced by $dy_i$, where $y_i$ denotes the thickness of the i-th layer. In this case, Expression (2) becomes as follows.

$$y_0=\Sigma(E_i\int_{A_i}ydy_i)/\Sigma E_iy_i \quad (3)$$

In the exemplary embodiment, n is 3. By substituting the Young's moduli and thicknesses of the base layer 611, the conductive heating layer 612, and the protective layer 613 in Expression (3), $y_0$ is determined.

That is, the distance $y_0$ to the neutral axis is determined by the Young's moduli and thicknesses of the base layer 611, the conductive heating layer 612, and the protective layer 613 that form the metal body.

Therefore, to set the neutral axis of the metal body so as to reside in the protective layer 613 in a case where, for example, the base layer 611 and the protective layer 613 are made of the same material such as non-magnetic stainless steel, the protective layer 613 is made thicker than the base layer 611. In a case where the base layer 611 and the protective layer 613 are made of different materials, the Young's modulus of the protective layer 613 is made larger than the Young's modulus of the base layer 611. Moreover, the two methods may be combined.

In the exemplary embodiment, the neutral axis of the metal body resides on the side of the protective layer 613 with respect to the thickness center line of the metal body in the section of the fixing belt 61 taken in the thickness direction. As described above, a relatively large tensile stress tends to occur in the protective layer 613. Nevertheless, if the above configuration is employed, the tensile stress acting on the protective layer 613 is reduced, and the occurrence of cracks in the protective layer 613 is suppressed.

Pressure Receiving Pad

The pressure receiving pad 63 is made of resin such as liquid crystalline polymer and is supported by the holder 65 at a position facing the pressure applying roller 62. In a state where the pressure receiving pad 63 is pressed by the pressure applying roller 62 with the fixing belt 61 interposed therebetween, the nip part N (press-fixing part) is formed between the pressure receiving pad 63 and the pressure applying roller 62.

The pressure receiving pad 63 includes a pre-nip region 63*a* on an entrance side of the nip part N (the upstream side in the direction of transport of the paper P) and a releasing nip region 63*b* on an exit side of the nip part N (the downstream side in the direction of transport of the paper P). The pre-nip region 63*a* and the releasing nip region 63*b* receive different nip pressures. Specifically, a surface of the pre-nip region 63*a* nearer to the pressure applying roller 62 extends in an arc shape substantially along the outer peripheral surface of the pressure applying roller 62 and receives a relatively uniform nip pressure over a wide area of the nip part N. The releasing nip region 63*b* has such a shape that a portion of the fixing belt 61 running therealong has a small radius of curvature. Furthermore, the releasing nip region 63*b* receives a large nip pressure locally applied thereto from the surface of the pressure applying roller 62. Thus, a curl in a direction away from the surface of the fixing belt 61 (a down curl) is formed in the paper P running along the releasing nip region 63*b*, whereby releasing of the paper P from the surface of the fixing belt 61 is facilitated.

In the exemplary embodiment, the release assisting member 70 as an assist member that assists releasing of the paper P by the pressure receiving pad 63 is provided on the downstream side with respect to the nip part N. The release assisting member 70 includes a release baffle 71 and a holder 72 that supports the release baffle 71. The release baffle 71 is oriented in a direction (counter direction) opposite to the direction of rotation of the fixing belt 61 and extends to a position close to the fixing belt 61. The release baffle 71 supports the curl formed in the paper P at the exit of the pressure receiving pad 63, thereby preventing the paper P from advancing along the fixing belt 61.

Temperature-Sensitive Magnetic Member

The temperature-sensitive magnetic member 64 has an arc shape extending along the inner peripheral surface of the fixing belt 61. The temperature-sensitive magnetic member 64 is positioned close to, but is not in contact with, the inner peripheral surface of the fixing belt 61 with a predetermined gap (0.5 mm to 1.5 mm, for example) interposed therebetween. The temperature-sensitive magnetic member 64 positioned closed to the fixing belt 61 so that the temperature of the temperature-sensitive magnetic member 64 changes with the temperature of the fixing belt 61, that is, the temperature of the temperature-sensitive magnetic member 64 becomes substantially the same as the temperature of the fixing belt 61. The temperature-sensitive magnetic member 64 is not in contact with the fixing belt 61 so that the heat of the fixing belt 61 is prevented from being absorbed into the temperature-sensitive magnetic member 64 before the fixing belt 61 is heated to the preset fixing temperature after the power of the image forming apparatus 1 is turned on. Thus, the warm-up time is reduced.

The temperature-sensitive magnetic member 64 is made of such a material that the temperature at which the magnetic permeability, one of magnetic properties, of the material suddenly changes (described separately below) is at or above the preset fixing temperature, at which toner images in different colors melt, and below the heat resistant temperatures of the elastic layer 614 and the release layer 615 of the fixing belt 61. In other words, the temperature-sensitive magnetic member 64 is made of a material exhibiting "temperature-sensitive magnetism", that is, the temperature-sensitive magnetic member 64 changes reversibly between exhibiting ferromagnetism and non-magnetism (paramagnetism) in a temperature range including the preset fixing temperature. At or below the temperature at which magnetic permeability starts to change, the temperature-sensitive magnetic member 64 is ferromagnetic and functions as a magnetic-circuit-producing member that induces thereinto lines of magnetic force produced by the IH heater 80 and intersecting the fixing belt 61, thereby producing an alternating-current magnetic circuit (lines of magnetic force), part of which runs through the temperature-sensitive magnetic member 64. Thus, the temperature-sensitive magnetic member 64 produces a closed magnetic circuit enclosing the fixing belt 61 and an exciting coil 82 (see FIG. 6) of the IH heater 80. In contrast, above the temperature at which magnetic permeability starts to change, the temperature-sensitive magnetic member 64 allows the lines of magnetic force produced by the IH heater 80 and intersecting the fixing belt 61 to pass therethrough in the thickness direction. Thus, the lines of magnetic force produced by the IH heater 80 and intersecting the fixing belt 61 form a magnetic circuit intersecting the temperature-sensitive magnetic member 64, running through the induction member 66, and returning to the IH heater 80.

The "temperature at which magnetic permeability starts to change" refers to a temperature at which magnetic permeability (measured in accordance with JIS C2531, for example) starts to drop continuously, specifically, a temperature at which the amount of magnetic flux (the number of lines of magnetic force) permeating through the temperature-sensitive magnetic member 64 and other elements starts to change. That is, the temperature at which magnetic permeability starts to change is close to the Curie point, at which materials lose their magnetism, but is based on a concept different from the Curie point.

The temperature-sensitive magnetic member 64 is made of such a material that the temperature at which magnetic permeability starts to change is set so as to be within the range of, for example, 140° C. (the preset fixing temperature) to 240° C. Examples of such a material include binary temperature-sensitive magnetic alloys such as an Fe—Ni alloy (permalloy) and ternary temperature-sensitive magnetic alloys such as an Fe—Ni—Cr alloy. In the case of an Fe—Ni binary temperature-sensitive magnetic alloy, the temperature at which magnetic permeability starts to change may be set to about 225° C. in a proportion (atomic ratio) of about 64% for Fe to about 36% for Ni. Metal alloys such as permalloys and temperature-sensitive magnetic alloys are easy to mold and easy to machine, have high heat conductivity, and are inexpensive. Therefore, such metal alloys are suitable for the temperature-sensitive magnetic member 64. Exemplary components of such metal alloys include Fe, Ni, Si, B, Nb, Cu, Zr, Co, Cr, V, Mn, and Mo.

The temperature-sensitive magnetic member 64 is made thicker than the skin depth 6 (see Expression (1) above) that allows entry of the alternating-current magnetic field (lines of magnetic force) produced by the IH heater 80. For example, in the case of an Fe—Ni alloy, the thickness of the temperature-sensitive magnetic member 64 is set to about 50 μm to about 300 μm.

Holder

The holder 65 supporting the pressure receiving pad 63 is made of a highly rigid material so that the amount of bend thereof occurring when a pressing force is applied by the pressure applying roller 62 becomes smaller than a predetermined amount. Thus, the pressure at the nip part N (nip pressure) is maintained to be uniform in the longitudinal direction. The fixing unit 60 according to the exemplary embodiment employs a configuration in which the fixing belt 61 is heated by utilizing electromagnetic induction. Accordingly, the holder 65 is made of a material that does not affect or hardly affects the induction field and is not affected or is hardly affected by the induction field. Examples of such a material include heat-resistive resins such as glass-filled polyphenylene sulfide (PPS), and non-magnetic metals such as Al, Cu, and Ag.

Induction Member

The induction member 66 has an arc shape extending along the inner peripheral surface of the temperature-sensitive magnetic member 64. The induction member 66 is not in contact with the inner peripheral surface of the temperature-sensitive magnetic member 64 with a predetermined gap (1.0 mm to 5.0 mm, for example) interposed therebetween. The induction member 66 is made of non-magnetic metal, such as Ag, Cu, or Al, having relatively small resistivity. When the temperature-sensitive magnetic member 64 is heated to a temperature above the temperature at which magnetic permeability starts to change, the induction member 66 induces thereinto the alternating-current magnetic field (lines of magnetic forces) produced by the IH heater 80, thereby falling into a state where an eddy current I occurs more easily than in the conductive heating layer 612 of the fixing belt 61. Hence, the induction member 66 has a predetermined thickness (1.0 mm, for example) much larger than the skin depth δ (see Expression (1) above) so as to allow the eddy current I to easily flow therethrough.

IH Heater

The IH heater 80 will now be described. The IH heater 80 performs electromagnetic induction heating by producing an alternating-current magnetic field acting on the conductive heating layer 612 of the fixing belt 61.

Figure 6:
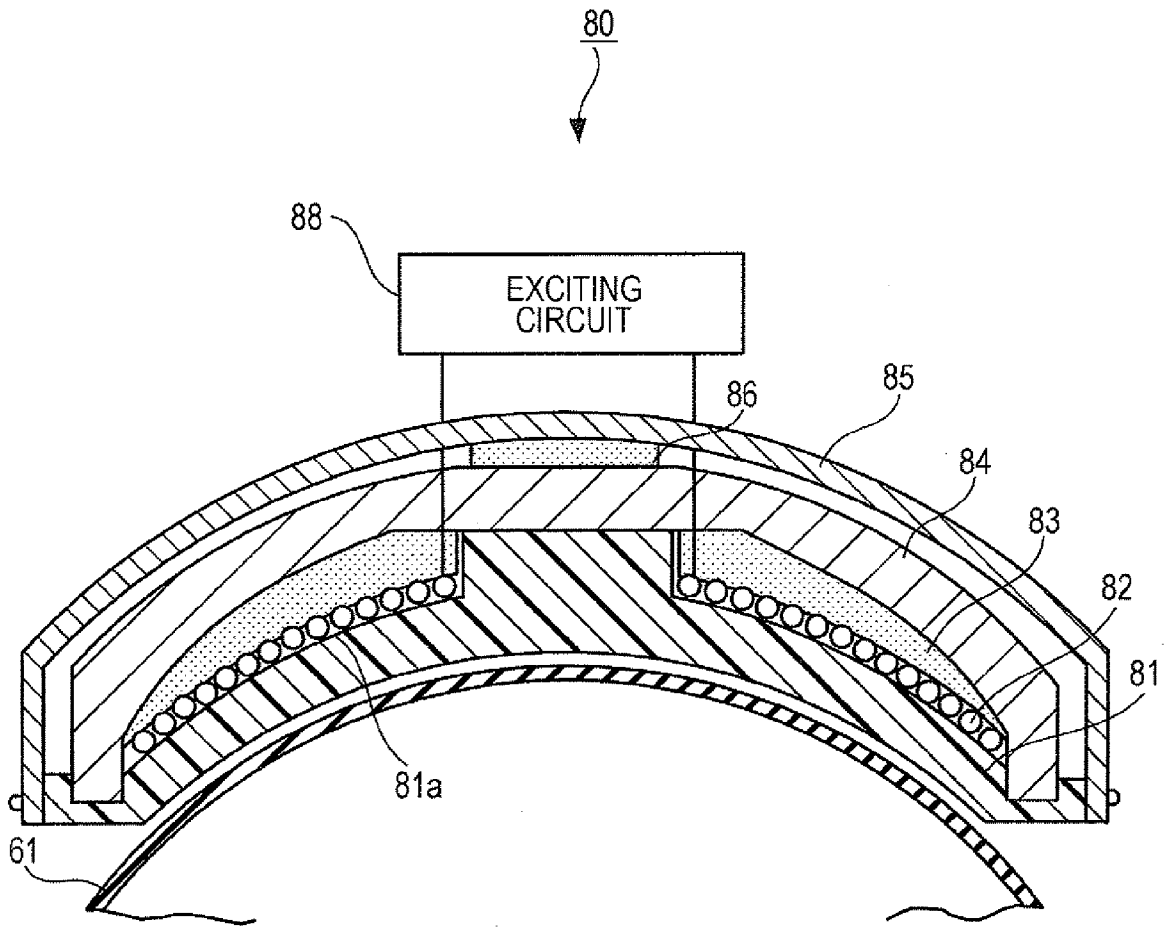
FIG. 6 is a sectional view of an IH heater according to the exemplary embodiment.

FIG. 6 is a sectional view of the IH heater 80 according to the exemplary embodiment. As illustrated in FIG. 6, the IH heater 80 includes a support 81 made of a non-magnetic material such as heat-resistive resin, the exciting coil 82 producing an alternating-current magnetic field, an elastic support member 83 made of an elastic material and securing the exciting coil 82 on the support 81, a magnetic core 84 producing a circuit of the alternating-current magnetic field produced by the exciting coil 82, a shield 85 shielding the magnetic field, a pressing member 86 pressing the magnetic core 84 toward the support 81, and the exciting circuit 88 supplying an alternating current to the exciting coil 82.

The support 81 has a curved sectional shape extending along the surface of the fixing belt 61 and is positioned such that an upper surface (supporting surface) 81*a* thereof supporting the exciting coil 82 is retained at a predetermined distance (0.5 mm to 2 mm, for example) from the surface of the fixing belt 61. The support 81 is made of a heat-resistive non-magnetic material: for example, heat-resistive glass; heat-resistive resin such as polycarbonate, polyether sulfone, or PPS; or a material obtained by adding glass fibers to the foregoing heat-resistive resin.

The exciting coil 82 is produced by coiling a Litz wire into a hollow closed loop having any shape such as an oblong circular shape, an elliptic shape, or a rectangular shape. The Litz wire is a bundle of, for example, 90 copper wires insulated from one another and each having a diameter of, for example, 0.17 mm. When an alternating current at a predetermined frequency is supplied from the exciting circuit 88 to the exciting coil 82, an alternating-current magnetic field centered on the Litz wire coiled into the closed loop is produced around the exciting coil 82. The frequency of the alternating current supplied from the exciting circuit 88 to the exciting coil 82 usually ranges from 20 kHz to 100 kHz, corresponding to the frequency of the alternating current generated by the above-mentioned general-purpose power supply.

The magnetic core 84 is a ferromagnetic body composed of an acid compound or an alloy having high magnetic permeability such as soft ferrite, ferrite resin, an amorphous alloy, a permalloy, or a temperature-sensitive magnetic alloy. The magnetic core 84 functions as a magnetic-circuit-producing member and induces thereinto lines of magnetic force (magnetic flux) of the alternating-current magnetic field produced by the exciting coil 82 and produces a path of the lines of magnetic force (magnetic circuit) running from the magnetic core 84, intersecting the fixing belt 61 toward the temperature-sensitive magnetic member 64, running through the temperature-sensitive magnetic member 64, and returning to the magnetic core 84. That is, the alternating-current magnetic field produced by the exciting coil 82 runs through the magnetic core 84 and the temperature-sensitive magnetic member 64, thereby producing a closed magnetic circuit with lines of magnetic force enclosing the fixing belt 61 and the exciting coil 82. Thus, the lines of magnetic force of the alternating-current magnetic field produced by the exciting coil 82 concentrate in a portion of the fixing belt 61 that faces the magnetic core 84.

The magnetic core 84 may be made of a material that causes a small loss due to the magnetic circuit. Specifically, the magnetic core 84 may be used in a form that reduces the eddy current loss (for example, a configuration in which the current path is cut off or divided with slits or the like, or a configuration including thin plates tied to one another) and may be made of a material causing a small hysteresis loss.

The length of the magnetic core 84 in the direction of rotation of the fixing belt 61 is smaller than the length of the temperature-sensitive magnetic member 64 in the direction of rotation of the fixing belt 61. Thus, leakage of lines of magnetic force around the IH heater 80 is reduced, and the power factor is increased. Moreover, electromagnetic induction into metal members included in the fixing unit 60 is suppressed, and the efficiency in heating the fixing belt 61 (the conductive heating layer 612) is increased.

State where Fixing Belt Generates Heat

A state where the fixing belt 61 generates heat with the alternating-current magnetic field produced by the IH heater 80 will now be described.

As described above, the temperature of the temperature-sensitive magnetic member 64 at which magnetic permeability starts to change is set so as to be at or above the preset fixing temperature at which toner images in different colors are fixed and at or below the heat resistant temperature of the fixing belt 61, i.e., within the range of 140° C. to 240° C., for example. When the fixing belt 61 is at or below the temperature at which magnetic permeability starts to change, the temperature-sensitive magnetic member 64 provided close to the fixing belt 61 is also at or below the temperature at which magnetic permeability starts to change, correspondingly to the fixing belt 61. In this state, the temperature-sensitive magnetic member 64 is ferromagnetic, and there is produced a magnetic circuit in which lines of magnetic force H of the alternating-current magnetic field produced by the IH heater 80 intersect the fixing belt 61 and run through the temperature-sensitive magnetic member 64 in a spreading direction. Here, the term "spreading direction" refers to a direction orthogonal to the thickness direction of the temperature-sensitive magnetic member 64.

Figure 7:
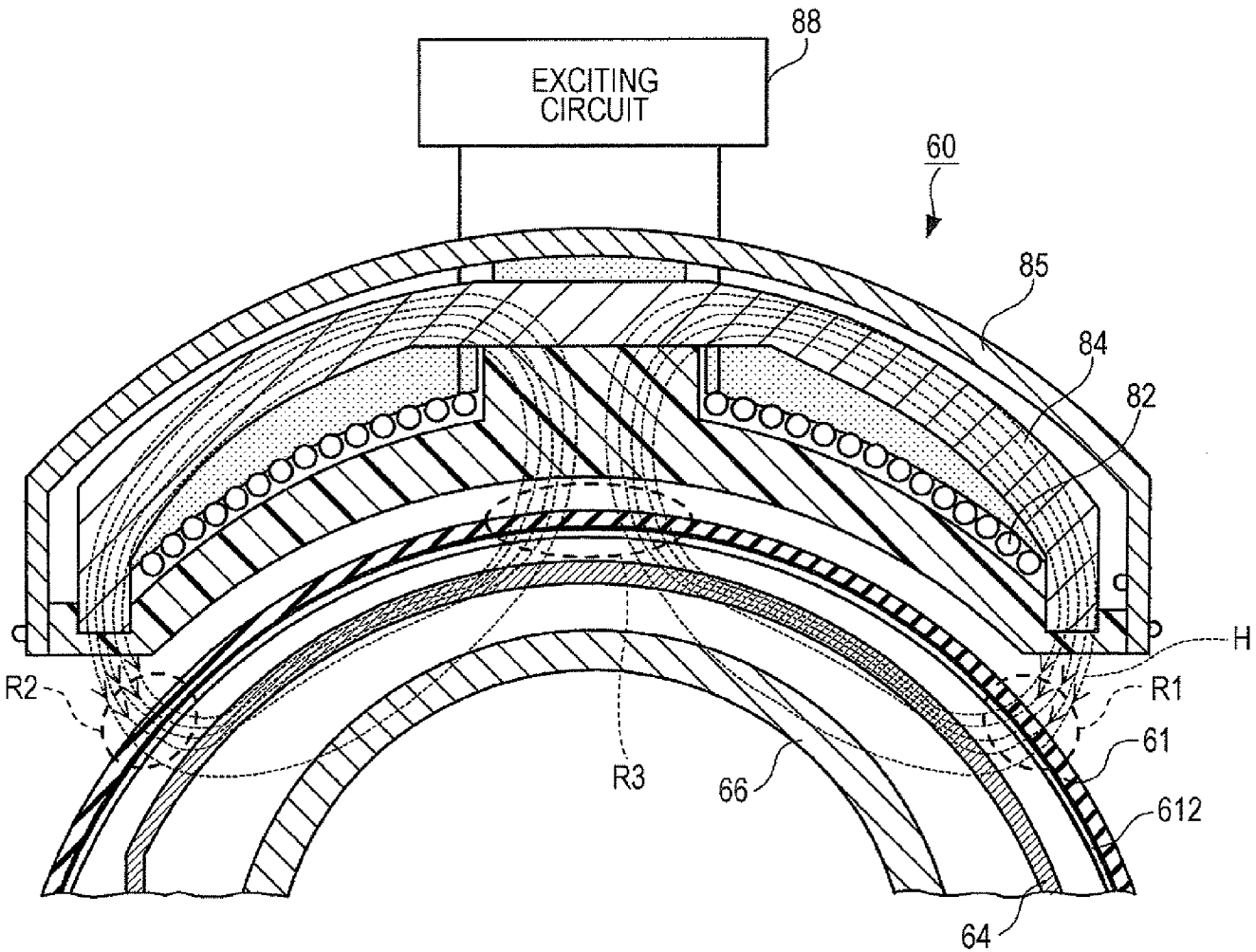
FIG. 7 illustrates lines of magnetic force produced when the fixing belt is at or below a temperature at which magnetic permeability starts to change.

FIG. 7 illustrates lines of magnetic force (H) when the fixing belt 61 is at or below the temperature at which magnetic permeability starts to change. As illustrated in FIG. 7, when the fixing belt 61 is at or below the temperature at which magnetic permeability starts to change, the lines of magnetic force H of the alternating-current magnetic field produced by the IH heater 80 form a magnetic circuit intersecting the fixing belt 61 and running through the temperature-sensitive magnetic member 64 in the spreading direction (the direction orthogonal to the thickness direction). Therefore, the number of lines of magnetic force H per unit area (magnetic flux density) in each region of the fixing belt 61 where the lines of magnetic force H intersect the conductive heating layer 612 is large.

Specifically, after the lines of magnetic force H radiated from the magnetic core 84 of the IH heater 80 pass through the conductive heating layer 612 of the fixing belt 61 in regions R1 and R2, the lines of magnetic force H are induced into the temperature-sensitive magnetic member 64 that is ferromagnetic. Therefore, the lines of magnetic force H intersecting the conductive heating layer 612 of the fixing belt 61 in the thickness direction concentrate in such a manner as to enter the temperature-sensitive magnetic member 64. Accordingly, the magnetic flux density is high in the regions R1 and R2. Furthermore, when the lines of magnetic force H that have run through the temperature-sensitive magnetic member 64 in the spreading direction return to the magnetic core 84 through a region R3 where the lines of magnetic force H intersect the conductive heating layer 612 in the thickness direction, the lines of magnetic force H are concentratedly radiated from portions of the temperature-sensitive magnetic member 64 having low magnetic potentials toward the magnetic core 84. Therefore, the lines of magnetic force H intersecting the conductive heating layer 612 of the fixing belt 61 in the thickness direction are concentratedly radiated from the temperature-sensitive magnetic member 64 toward the magnetic core 84, increasing the magnetic flux density in the region R3.

In the conductive heating layer 612 of the fixing belt 61 in which the lines of magnetic force H intersect in the thickness direction, an eddy current I occurs in proportion to the amount of change in the number of lines of magnetic force H per unit area (magnetic flux density). Therefore, as illustrated in FIG. 7, a large eddy current I occurs in each of the regions R1 and R2 and the region R3 where the amount of change in the magnetic flux density is large. The eddy current I occurring in the conductive heating layer 612 generates Joule heat W ($W=I^2R$), which is the product of the resistivity R of the conductive heating layer 612 and the square of the eddy current I. Hence, in each of the regions of the conductive heating layer 612 where a large eddy current I occurs, high Joule heat W is generated.

Thus, when the fixing belt 61 is at or below the temperature at which magnetic permeability starts to change, high heat is generated in the regions R1 and R2 and the region R3 where the lines of magnetic force H intersect the conductive heating layer 612. Consequently, the fixing belt 61 is heated.

In the fixing unit 60 according to the exemplary embodiment, the temperature-sensitive magnetic member 64 is provided close to the fixing belt 61 on the inner peripheral side of the fixing belt 61. Thus, a configuration is realized in which the magnetic core 84 that induces thereinto the lines of magnetic force H produced by the exciting coil 82 and the temperature-sensitive magnetic member 64 that induces thereinto the lines of magnetic force H intersecting the fixing belt 61 in the thickness direction are provided close to each other. Accordingly, the alternating-current magnetic field produced by the IH heater 80 (exciting coil 82) forms a magnetic circuit in the form of a short loop. Such a magnetic circuit has a high magnetic flux density and a high degree of magnetic coupling. Therefore, when the fixing belt 61 is at or below the temperature at which magnetic permeability starts to change, the fixing belt 61 generates heat very efficiently.

Pressure Applying Roller

The pressure applying roller 62 faces the fixing belt 61 and rotates in the direction of arrow D illustrated in FIG. 3 at a process speed of, for example, 140 mm/s. The nip part N is formed when the fixing belt 61 is nipped between the pressure applying roller 62 and the pressure receiving pad 63. When paper P having unfixed toner images is transported through the nip part N, heat and pressure are applied to the toner images, whereby the unfixed toner images are fixed on the paper P.

The pressure applying roller 62 includes a solid aluminum core (round-columnar metal core) 621 having an exemplary diameter of 18 mm, a heat-resistive elastic layer 622 provided over the outer peripheral surface of the core 621 and made of silicone sponge or the like with an exemplary thickness of 5 mm, and a release layer 623 provided over the heat-resistive elastic layer 622 and as a heat-resistive resin coating composed of carbon-filled PFA or the like or a heat-resistive rubber coating with an exemplary thickness of 50 μm. The pressure applying roller 62 presses the pressure receiving pad 63 with an exemplary load of 20 kgf with the fixing belt 61 interposed therebetween.

Thus, the heat-resistive elastic layer 622 and the release layer 623 that form the surface of the pressure applying roller 62 are made of relatively soft materials. Therefore, if the pressure applying roller 62 is kept being pressed against the pressure receiving pad 63 with the fixing belt 61 interposed therebetween while the fixing operation is not being performed, the pressure applying roller 62 may not be able to restore its original shape. That is, the pressure applying roller 62 may be deformed into a shape defined at the nip part N (press-fixing part). In such a case, the pressure applied at the nip part N may deviate from the design value and the fixing operation may not be performed as specified, resulting in deterioration in the performance of the fixing unit 60.

Therefore, the movement mechanism 200 is provided to the pressure applying roller 62 so as to move the pressure applying roller 62 away from the fixing belt 61 when the fixing operation is not performed. Specifically, when the fixing operation is performed, the pressure applying roller 62 is pressed against the outer peripheral surface of the fixing belt 61 so that the pressure applying roller 62 and the fixing belt 61 form the nip part N therebetween through which paper P having an unfixed image is transported. When the fixing operation is not performed, the pressure applying roller 62 is moved away from the fixing belt 61. That is, in the exemplary embodiment, the pressure applying roller 62 is changeable by the movement mechanism 200 between being pressed against the outer peripheral surface of the fixing belt 61 and being spaced apart from the fixing belt 61.

Figure 8:
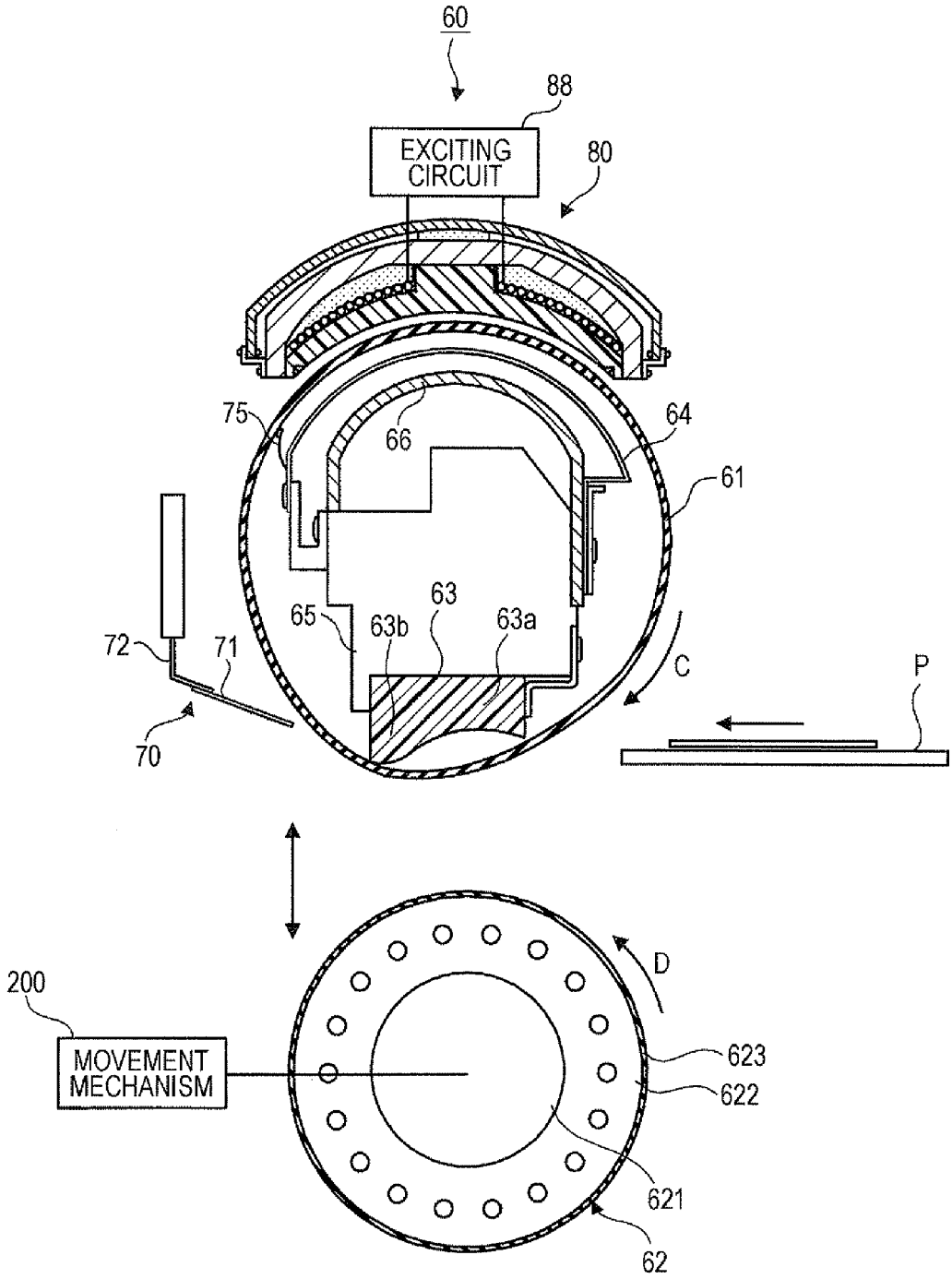
FIG. 8 illustrates a pressure applying roller having been moved away from the fixing belt by a movement mechanism.

FIG. 8 illustrates the pressure applying roller 62 having been moved away from the fixing belt 61 by the movement mechanism 200.

In FIG. 8, the pressure applying roller 62 is spaced apart from the fixing belt 61. Therefore, the pressure applying roller 62 has its original circular shape. Thus, the probability that the pressure applying roller 62 that has been deformed may not be able to restore its original shape is reduced.

When the fixing operation is performed, the pressure applying roller 62 is brought into contact with the fixing belt 61 again by the movement mechanism 200, whereby the pressure applying roller 62 returns to such a position that the nip part N illustrated in FIG. 3 is formed.

Drive Mechanism for Pressure Applying Roller and Fixing Belt

Referring to FIGS. 2, 3, and 8, a drive mechanism provided for the pressure applying roller 62 and the fixing belt 61 of the fixing unit 60 according to the exemplary embodiment will now be described.

Here, suppose that the fixing unit 60 is in the state before the fixing operation as illustrated in FIG. 8 where the pressure applying roller 62 is spaced apart from the fixing belt 61. In such a standby state before the fixing operation, the pressure applying roller 62 is retained at a warm-up position away from the fixing belt 61 by the movement mechanism 200. The warm-up position refers to the position of the pressure applying roller 62 during the warm-up time. In this state, the pressure applying roller 62 is latched off, that is, the pressure applying roller 62 is not in physical contact with the fixing belt 61.

Referring to FIG. 2, in the fixing unit 60, a rotational driving force is transmitted from a drive motor 90 as an exemplary drive unit to a shaft 97 through a transmission gear 92 fixed to a rotating shaft 91 and through transmission gears 93, 94, 95, and 96. Thus, the rotational driving force is transmitted to the pressure applying roller 62, and the pressure applying roller 62 rotates in the direction of arrow D.

The rotational driving force from the drive motor 90 is also transmitted to a shaft 103 through a transmission gear 101 fixed to the rotating shaft 91 coaxially with the transmission gear 92 and through a one-way clutch 102 as an exemplary rotation-transmission-regulating member. The rotational driving force is further transmitted to gear portions 67*b* of end cap members 67 provided at two respective ends of the fixing belt 61 through respective transmission gears 104 and 105 provided on the shaft 103. Thus, the rotational driving force is transmitted from the end cap members 67 to the fixing belt 61, and the end cap members 67 and the fixing belt 61 rotate together. In this operation, the fixing belt 61 directly receives the driving force at the two ends thereof and thus rotates in the direction of arrow C.

In the state illustrated in FIG. 3 where the fixing operation is performed, the fixing unit 60 is latched on, with the pressure applying roller 62 being pressed against the fixing belt 61 by the movement mechanism 200. The speed reduction ratio of the train of gears in the latched-off state is set to such a value that the surface speed of the fixing belt 61 becomes slower than the surface speed of the pressure applying roller 62. Therefore, in the latched-on state, the one-way clutch 102 operates such that the fixing belt 61 rotates by following the rotation of the pressure applying roller 62, and the transmission of the rotational driving force from the drive motor 90 to the shaft 103 is stopped. That is, in the state illustrated in FIG. 3, the rotational driving force is transmitted to the pressure applying roller 62 but is not transmitted to the fixing belt 61. Hence, while the pressure applying roller 62 receiving the rotational driving force from the drive motor 90 rotates in the direction of arrow D, the fixing belt 61 rotates in the direction of arrow C by following the rotation of the pressure applying roller 62. In this state, the drive motor 90 rotates the fixing belt 61 by rotating the pressure applying roller 62.

The fixing unit 60 according to the exemplary embodiment includes a revolution counter 107 that detects the number of revolutions of the fixing belt 61. The number of revolutions of the fixing belt 61 detected by the revolution counter 107 is output to a fixing unit controller 300. The fixing unit controller 300 controls the drive motor 90. Specifically, the fixing unit controller 300 controls the drive motor 90 in a feedback manner on the basis of the number of revolutions of the fixing belt 61 detected by the revolution counter 107. The fixing unit controller 300 also controls the movement mechanism 200. By causing the movement mechanism 200 to move the pressure applying roller 62, the fixing unit controller 300 changes the state of the pressure applying roller 62 between being pressed against the fixing belt 61 and being spaced apart from the fixing belt 61.

The movement mechanism 200 includes a latch motor 201 as a positioning drive source, a rotating shaft 202 connected to the latch motor 201, transmission gears 203 and 204, a shaft 205 connected to the transmission gear 204, eccentric cams 206 rotating with the shaft 205, and levers 207 connected to the shaft 97 of the pressure applying roller 62 and moved by the respective eccentric cams 206. When the eccentric cams 206 rotate, the levers 207 are pushed by the respective eccentric cams 206 and cause the pressure applying roller 62 to move in the vertical direction in FIG. 2. Thus, the pressure applying roller 62 is movable to and away from the fixing belt 61.

EXAMPLES

The exemplary embodiment of the present invention will be described in more detail by taking some examples. The present invention is not limited to the following examples unless departing from the scope thereof.

Testing Method

Examples A1 to A6

Toner images are fixed by using the fixing unit 60 described with reference to FIGS. 2 to 8, and a test for the durability of the fixing belt 61 is conducted. In this test, the durability of the fixing belt 61 is graded in three ranks of good, OK, and no good. FIG. 9 summarizes combinations of materials of the protective layer 613, the conductive heating layer 612, and the base layer 611 of the fixing belt 61 and thicknesses of the individual layers. In FIG. 9, SUS denotes stainless steel, and Fe—Ni denotes an iron-nickel alloy.

Comparative Examples B1, C1 and C2, and D1 to D6

A test is conducted in the same manner as for Examples A1 to A6 but with combinations of materials of the protective layer 613, the conductive heating layer 612, and the base layer 611 of the fixing belt 61 and thicknesses of the individual layers summarized in FIG. 9.

Results

In each of Examples A1 to A6, the durability of the fixing belt 61 is good. Examples A1 to A6 each satisfy the following criteria: (1) the neutral axis of the metal body included in the fixing belt 61 resides in the protective layer 613, and (2) the neutral axis resides on the side of the protective layer 613 with respect to the thickness center line of the metal body. In FIG. 9, Criterion (1) is represented by the distance from the interface between the protective layer 613 and the conductive heating layer 612 to the neutral axis. If Criterion (1) is satisfied, the distance is a positive value; if not, the distance is zero or a negative value. Criterion (2) is represented by the distance from the surface of the protective layer 613 to the neutral axis. If Criterion (2) is satisfied, the distance is shorter than 27.5 μm, that is, shorter than half the total thickness of 55 μm of the metal body; if not, the distance is 27.5 μm or longer.

Comparative Example B1 satisfies Criterion (1) but does not satisfy Criterion (2). In Comparative Example B1, the neutral axis resides in the protective layer 613 but on the side of the base layer 611 with respect to the thickness center line of the metal body. In this case, the durability of the fixing belt 61 is graded no good.

Comparative Examples C1 and C2 each satisfy Criterion (2) but do not satisfy Criterion (1). In each of Comparative Examples C1 and C2, the neutral axis resides on the side of the protective layer 613 with respect to the thickness center line of the metal body but in the conductive heating layer 612. In this case, the durability of the fixing belt 61 is graded OK, i.e., not very good.

Comparative Examples D1 to D6 each satisfy neither of Criteria (1) and (2). In each of Comparative Examples D1 to D6, the neutral axis resides in the conductive heating layer 612 and on the side of the base layer 611 with respect to the thickness center line of the metal body. In this case, the durability of the fixing belt 61 is graded no good.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:
a magnetic-field-producing member that produces an alternating-current magnetic field;
a fixing belt that is heated by electromagnetic induction caused by the alternating-current magnetic field and fixes toner on a recording material; and
a pressure applying member that is pressed against an outer peripheral surface of the fixing belt and forms a press-fixing part therebetween through which the recording material having an unfixed image is transported,
wherein the fixing belt includes a metal body in which at least three layers are stacked, the at least three layers including
a base layer made of metal;
a protective layer made of metal; and
a conductive layer provided between the base layer and the protective layer and to be heated by electromagnetic induction, and
wherein, in a section of the fixing belt taken in a thickness direction, a neutral axis of the metal body resides on a side of the protective layer with respect to a thickness center line of the metal body and in the protective layer.

2. The fixing device according to claim 1, wherein the protective layer is thicker than the base layer.

3. The fixing device according to claim 2, wherein the protective layer has a larger Young's modulus than the base layer.

4. The fixing device according to claim 3 further comprising:
an elastic layer overlying the metal body; and
a release layer overlying the elastic layer.

5. The fixing device according to claim 4, wherein the metal body is clad steel.

6. The fixing device according to claim 3, wherein the metal body is clad steel.

7. The fixing device according to claim 2 further comprising:
an elastic layer overlying the metal body; and
a release layer overlying the elastic layer.

8. The fixing device according to claim 7, wherein the metal body is clad steel.

9. The fixing device according to claim 2, wherein the metal body is clad steel.

10. The fixing device according to claim 1, wherein the protective layer has a larger Young's modulus than the base layer.

11. The fixing device according to claim 10 further comprising:

an elastic layer overlying the metal body; and a release layer overlying the elastic layer.

12. The fixing device according to claim 11, wherein the metal body is clad steel.

13. The fixing device according to claim 10, wherein the metal body is clad steel.

14. The fixing device according to claim 1 further comprising:

an elastic layer overlying the metal body; and a release layer overlying the elastic layer.

15. The fixing device according to claim 14, wherein the metal body is clad steel.

16. The fixing device according to claim 1, wherein the metal body is clad steel.

17. An image forming apparatus comprising:

a toner-image-forming section that forms a toner image;

a transfer section that transfers the toner image to a recording material; and a fixing section including a magnetic-field-producing member that produces an alternating-current magnetic field;

a fixing belt that is heated by electromagnetic induction caused by the alternating-current magnetic field and fixes toner on the recording material; and a pressure applying member that is pressed against an outer peripheral surface of the fixing belt and forms a press-fixing part therebetween through which the recording material having an unfixed image is transported, wherein the fixing belt includes a metal body in which at least three layers are stacked, the at least three layers including a base layer made of metal;

a protective layer made of metal; and a conductive layer provided between the base layer and the protective layer and to be heated by electromagnetic induction, and wherein, in a section of the fixing belt taken in a thickness direction, a neutral axis of the metal body resides on a side of the protective layer with respect to a thickness center line of the metal body and in the protective layer.

18. The image forming apparatus according to claim 17, wherein the metal body is clad steel.

19. An endless fixing belt comprising:

a metal body in which at least three layers are stacked, the at least three layers including a base layer made of metal, a conductive layer overlying the base layer and to be heated by electromagnetic induction, and a protective layer made of metal and overlying and protecting the conductive layer;

an elastic layer overlying the metal body; and a release layer overlying the elastic layer, wherein, in a section of the metal body taken in a thickness direction, a neutral axis of the metal body resides on a side of the protective layer with respect to a thickness center line of the metal body and in the protective layer.

20. The endless fixing belt according to claim 19, wherein the metal body is clad steel.

* * * * *